United States Patent [19]

Brumfield

[11] Patent Number: 4,574,828

[45] Date of Patent: Mar. 11, 1986

[54] HAND HELD AND HAND OPERATED PUMPING AND SIPHONING DEVICE

[75] Inventor: William B. Brumfield, Richmond, Ky.

[73] Assignee: SI-FLO, Inc., Richmond, Ky.

[21] Appl. No.: 725,907

[22] Filed: Apr. 22, 1985

[51] Int. Cl.[4] ..... F04F 10/00

[52] U.S. Cl. ..... 137/149; 137/151; 417/469

[58] Field of Search ..... 137/147, 148, 149, 150, 137/151; 417/469

[56] References Cited

U.S. PATENT DOCUMENTS

| | | | |
|---|---|---|---|
| 383,153 | 5/1888 | Siersdoafer | 137/151 X |
| 1,494,737 | 5/1924 | Counyer | 137/147 X |
| 2,233,123 | 2/1941 | Fritts | 137/147 |
| 2,341,129 | 2/1944 | Thompson | 137/149 |
| 3,594,103 | 7/1971 | Hillis | 417/448 X |

FOREIGN PATENT DOCUMENTS

| | | | |
|---|---|---|---|
| 1347 | of 1893 | United Kingdom | 137/148 |

*Primary Examiner*—Richard E. Gluck
*Attorney, Agent, or Firm*—Frank C. Leach, Jr.

[57] ABSTRACT

A hand held and hand operated device is capable of pumping or siphoning a liquid. The device includes a pair of telescoping hollow tubes having a single longitudinal axis with a seal therebetween that is maintained when one of the tubes is reciprocated relative to the other. Each of the tubes has a conical valve seat at its distal end with each conical valve seat having the same selected angle to the single longitudinal axis of the tubes. Each seat has a separate stainless steel ball to seal on the seat whenever the longitudinal axis of the tubes is at a greater angle to the horizontal than the selected angle of each conical seat to the longitudinal axis. In this position, reciprocation of the tubes causes pumping of the liquid through alternatively removing each of the balls from its seat due to pressure differentials created by changing the volume within the tubes between the balls. When reciprocation of the tubes has filled the device with liquid, siphoning can occur through holding the longitudinal axis of the tubes at an angle to the horizontal less than the selected angle of the conical valve seats to the longitudinal axis so that neither of the balls engages its seat. No priming is necessary to initiate siphoning since it depends solely upon the pumping action initially causing liquid to flow into the hollow tubes through which the liquid will continue to flow when siphoning is occurring.

20 Claims, 9 Drawing Figures

HAND HELD AND HAND OPERATED PUMPING AND SIPHONING DEVICE

This invention relates to a device for selectively pumping or siphoning a liquid and, more particularly, to a hand held and hand operated device for selectively pumping or siphoning a liquid with the position of the device relative to the horizontal determining whether pumping or siphoning can occur.

The siphoning of a liquid from a first location to a second and lower location can be produced through a user sucking on a hose having one end connected to the source of liquid to be siphoned. When the liquid reaches the user's mouth, positioning of the hose in the second and lower location results in siphoning.

This manual creation of a partial vacuum in the hose by the user cannot be employed when the liquid can injure the user such as an acid, for example. One means of siphoning an acid without injury to the user is disclosed in U.S. Pat. No. 2,341,129 to Thompson. In the aforesaid Thompson patent, an inlet branch of a U-shaped siphon is reciprocated within a casing disposed within a receptacle having an acid to be siphoned. The siphon of the aforesaid Thompson patent has a first ball valve in the casing cooperating with the end of the inlet branch and a second ball valve in an extension of an outlet branch and cooperating with the end of the outlet branch. The second ball valve must be closed during reciprocation of the inlet branch within the casing when a piston on the outer surface of the inlet branch cooperates with the inner surface of the casing to pump liquid into the siphon. When the siphon is full, the outlet valve must be manually opened by the user.

The siphon of the aforesaid Thompson patent is relatively large and cannot be readily used by one individual. This is because the user would have to lift the mass of the siphon including the mass of the liquid accumulating therein to reciprocate the siphon and still be able to open the outlet ball valve when the siphon is full. It is not seen how this can be accomplished by a single user because of the location of the outlet valve relative to where reciprocation of the inlet branch of the siphon occur with respect to the casing within the receptacle having the acid.

The device of the present invention avoids the problems of the siphon of the aforesaid Thompson patent in that the device of the present invention is of relatively light weight and may be easily hand held and used by one person. Furthermore, there is no requirement for any opening or closing of any valve by the user other than through changing the angle of the device with respect to the horizontal.

Furthermore, it is desired to sometimes be able to pump a liquid from a source rather than siphoning a liquid. The device of the present invention is capable of functioning to siphon a liquid or to pump the liquid as desired. Thus, the device of the present invention is not limited to siphoning liquid as in the aforesaid Thompson patent.

While U.S. Pat. No. 3,594,103 to Hillis discloses pumping of a liquid by reciprocation of an inner holloow tube within an outer hollow tube, this pump is not capable of creating a siphon. It also is not capable of manual utilization.

U.S. Pat. No. D. 220,840 to Rolsten et al discloses a manually operable pump. However, there is no disclosure of how this structure functions.

U.S. Pat. No. 2,960,040 to Bischoff discloses a pump device in which squeezing of a flexible chamber changes its volume to create pumping between an inlet ball check valve and an outlet ball check valve. However, the outlet ball check valve requires a spring to bias it closed. The pump device of the aforesaid Bischoff patent could not be utilized for siphoning since the spring biased outlet ball check valve could not be maintained in an open position as is required for siphoning.

The device of the present invention has a first hollow tube telescopingly received within a second hollow tube so that reciprocation therebetween changes the volume between the two ball check valves at distal ends of the hollow tubes. Each of the ball check valves cooperates with a valve seat with the valve seats having the same selected angle so that the positioning of the tubes, which have a single longitudinal axis, with their longitudinal axis disposed at an angle to the horizontal determines whether the device functions as a pump or a siphon.

When used as a pump, the device is disposed at an angle to the horizontal greater than the selected angle of the valve seats to the longitudinal axis of the tubes. In this position, reciprocating movement between the two tubes changes the volume to alternately open and close the two ball valves at the distal ends of the tubes to pump liquid therethrough.

When siphoning is desired, priming of the device is accomplished in the same manner as when pumping through reciprocating movement between the two tubes while holding the device with the longitudinal axis of the tubes at an angle to the horizontal greater than the selected angle of the valve seats. When the device is primed, the device is positioned so that the longitudinal axis of the tubes is at an angle to the horizontal smaller than the selected angle of the valve seats to prevent the ball valves from seating o their valve seats so that the liquid can flow through the tubes by a siphoning action with the ball valves not blocking flow.

An object of this invention is to provide a device for selectively pumping or siphoning a liquid from a source.

Another object of this invention is to provide a hand held and hand operated pumping and siphoning device.

Other objects of this invention will be readily perceived from the following description, claims, and drawings.

This invention relates to a hand held and hand operated device for pumping or siphoning a liquid including a first hollow tube and a second hollow tube telescopingly received within the first hollow tube to enable reciprocating movement therebetween with the first and second hollow tubes having a single longitudinal axis. A seal is formed between the first and second hollow tubes by sealing means, which maintains the seal during reciprocating movement between the first and second hollow tubes. The first hollow tube has first valve means at its distal end, and the second hollow tube has second valve means at its distal end. Each of the first and second valve means includes opening and closing means to open and close in response to reciprocating movement between the first and second hollow tubes when the first and second hollow tubes are disposed with their longitudinal axis at a first angle to the horizontal greater than a predetermined angle so that liquid is pumped from a liquid source communicating with the first valve means to beyond the second valve means. Each of the first and second valve means includes means to render the opening and closing means of each of the first and second valve means ineffective when the first and second hollow tubes are disposed with their longitudinal axis at a second angle to the horizontal smaller than the predetermined angle so that liquid is siphoned from a liquid source after the first and second hollow tubes have been disposed at the first angle and there has been reciprocating movement between the first and second hollow tubes to pump liquid beyond the second valve means.

The attached drawings illustrate a preferred embodiment of the invention, in which:

FIG. 1. is a longitudinal sectional view, partly in elevation, of a pumping and siphoning device of the present invention and showing the device in its siphoning position with the inner hollow tube fully retracted into the outer hollow tube;

Figure 1:
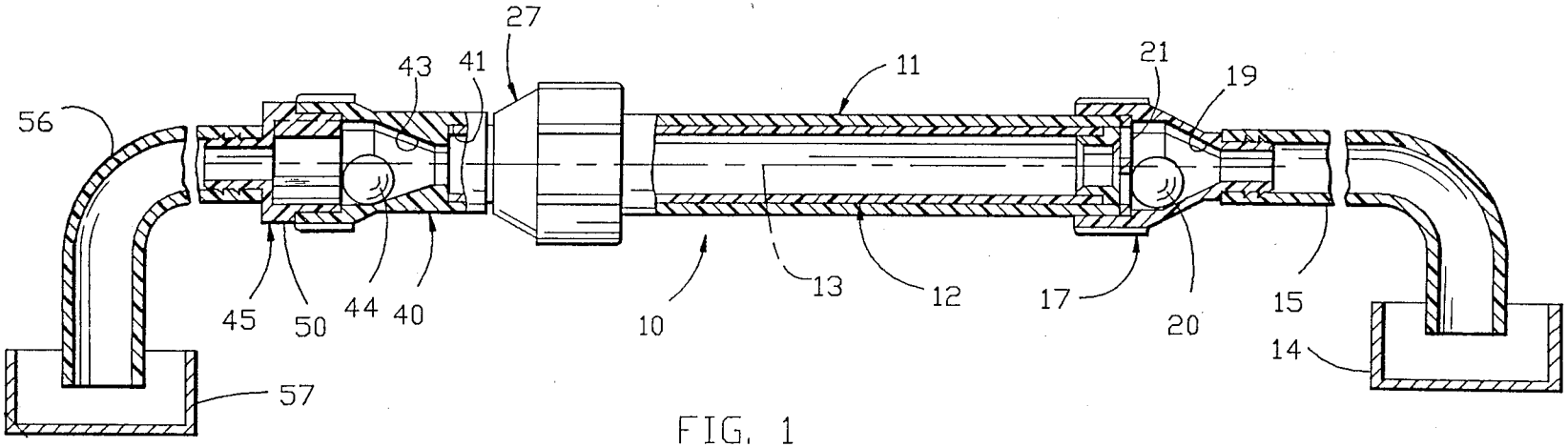
Figure 3:
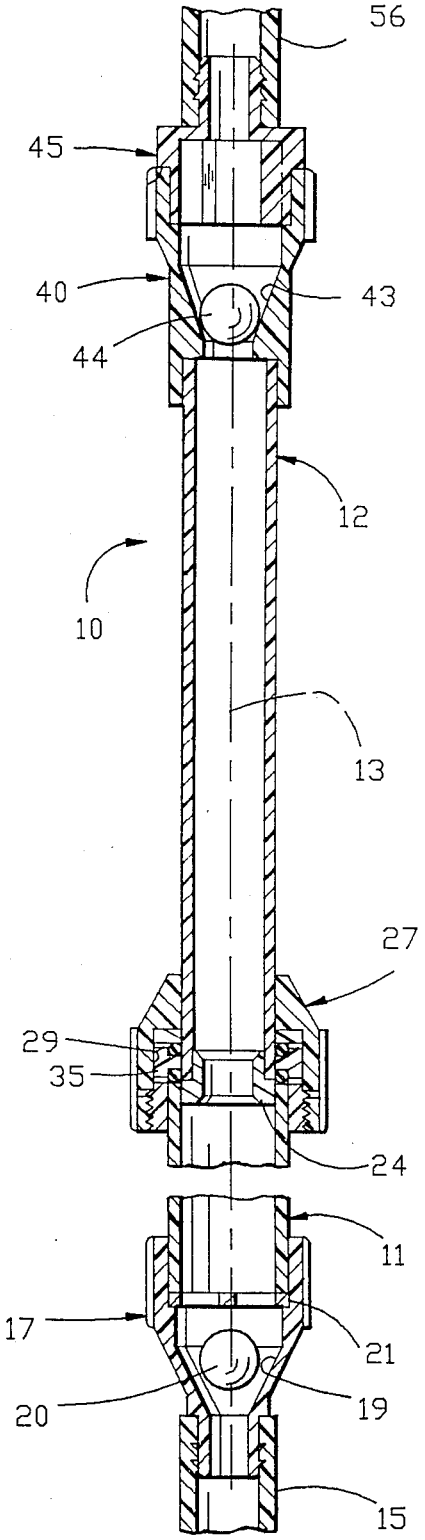
FIG. 3 is an enlarged fragmentary longitudinal sectional view, similar to FIG. 1, of the device of FIG. 1 and showing the device used as a pump with the inner hollow tube fully extended from the hollow tube.
Figure 9:
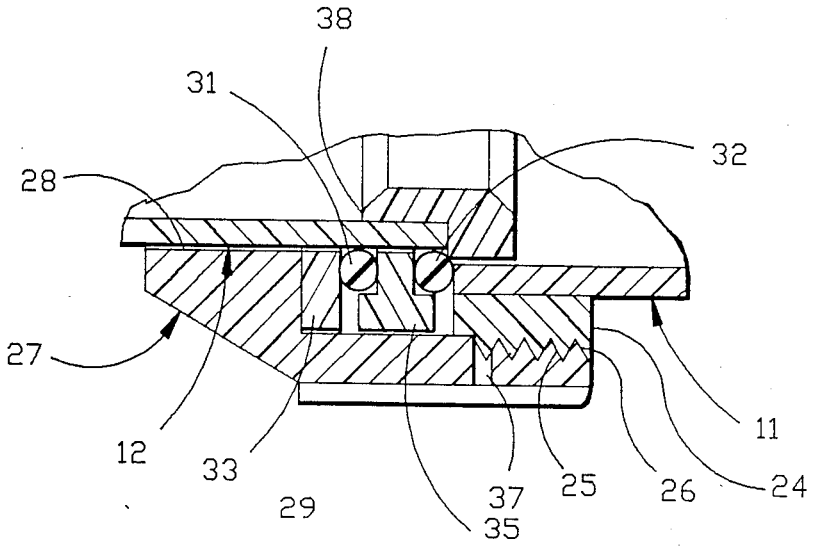
Figure 8:
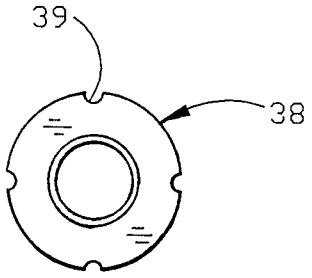

FIG. 8 is an end elevational view of a stop ring mounted at the end of the inner hollow tube of the device of FIG. 1 and taken from the larger end of the stop ring; and FIG. 9 is an enlarged fragmentary sectional view of a portion of the device of FIG. 1 and showing the stop ring engaging an O-ring when the inner tube is fully extended from the outer tube as shown in FIG. 3 to illustrate the relative clearances between parts.

Referring to the drawings and particularly FIG. 1, there is shown a hand held and hand operated pumping and siphoning device 10 for selectively pumping or siphoning a liquid. The device 10 includes an outer hollow tube 11, which functions as a body tube, and an inner hollow tube 12, which functions as a pump tube, telescopingly received within the outer hollow tube 11. The tubes 11 and 12 have a single longitudinal axis 13.

The outer hollow tube 11 receives liquid from a source 14 such as a container, for example, through a hose 15. The hose 15 is connected to a reduced portion 16 (see FIG. 2) of a hollow inlet fitting 17, which is mounted on the outer hollow tube 11. The reduced portion 16 of the hollow inlet fitting 17 has a pair of rings 18 on its outer surface to engage the hose 15 to retain the hose 15 connected to the device 10.

The hollow inlet fitting 17 has a conical valve seat 19 formed therein adjacent the reduced portion 16 with its center on the longitudinal axis 13 of the device 10. The conical valve seat 19 has a selected angle relative to the longitudinal axis 13 of the device 10. The angle of the conical valve seat 19 is preferably 22½° although any other suitable angle may be employed.

A ball valve 20 is disposed within the hollow inlet fitting 17 and cooperates with the conical valve seat 19 to control flow through the hollow inlet fitting 17. The position of the longitudinal axis 13 of the device 10 relative to the horizontal determines when the ball valve 20 ceases to engage the conical valve seat 19 to form a seal therewith. With the conical valve seat 19 having an angle of 22½° to the longitudinal axis 13 of the device 10, any disposition of the longitudinal axis 13 of the device 10 at an angle less than 22½° results in the ball valve 20 not engaging the conical valve seat 19.

The ball valve 20 is caged within the hollow inlet fitting 17 by a stop 21, which limits the movement of the ball valve 20 away from the conical valve seat 19. The stop 21 engages a shoulder 22 of the hollow inlet fitting 17 and is held thereagainst by an end of the outer hollow tube 11 disposed within a recess 23 in the hollow inlet fitting 17. The recess 23 has its side wall tapering towards the shoulder 22 to enable insertion of the outer hollow tube 11 therein. The hollow inlet fitting 17 is attached to the outer hollow tube 11 by suitable means such as an adhesive or ultrasonic welding, for example, between the outer surface of the outer hollow tube 11 and the side wall of the recess 23.

A collar 24 is attached to the other end of the outer hollow tube 11 by suitable means such as an adhesive or ultrasonic welding, for example. The collar 24 terminates at the end of the outer hollow tube 11. The collar 24 has threads 25 on most of its outer surface for cooperation with threads 26 on the interior surface of a locking nut 27.

The locking nut 27 has a first inner circular surface 28 slidably receiving the inner hollow tube 12 and having a relatively close fit therewith. The first inner circular surface 28 of the locking nut 27 functions as a guide for the inner hollow tube 12 to maintain its reciprocating motion along the longitudinal axis 13.

The locking nut 27 has a second inner circular surface 29 of larger diameter than the first inner circular surface 28 and spaced from the inner hollow tube 12 to form an annular recess 30 therebetween. Two O-rings 31 and 32 are disposed within the recess 30 to form a seal along the outer surface of the inner hollow tube 12, particularly between the outer surface of the inner hollow tube 12 and the end of the oute hollow tube 11.

A washer 33 is disposed between the O-ring 31 and a shoulder 34 of the locking nut 27 to prevent the O-ring 31 from being twisted by the locking nut 27 when the threads 26 on the locking nut 27 are threaded on the threads 25 of the collar 24. A washer 35, which has a T-shaped cross section, is disposed between the O-rings 31 and 32 to prevent the O-rings 31 and 32 from expanding in a direction parallel to the longitudinal axis 13. The T-shaped washer 35 overlies one-half of each of the O-rings 31 and 32.

When the locking nut 27 is locked to the collar 24, the O-rings 31 and 32 are effective to form a seal between the inner hollow tube 12 and the outer hollow tube 11. This prevents any leakage of air during reciprocation between the inner hollow tube 12 and the outer hollow tube 11.

Whenever it is desired to release the pressure within the interior of the hollow tubes 11 and 12, it is only necessary to slightly rotate the locking nut 27 from its locking position so that a pair of diametrically disposed openings 37, which extend from the outer surface of the locking nut 27 into the first of the threads 26, is no longer prevented from communicating with the O-ring 32 by the portion of the collar 24 having the threads and then retract the inner hollow tube 12 from the outer hollow tube 11 so that the O-ring 32 no longer seals against the end of the outer hollow tube 11. It should be understood that the slight rotation of the locking nut 27 renders the O-rings 31 and 32 ineffective so that the interior of the hollow tubes 11 and 12 is vented but this is much slower than also retracting the inner hollow tube 12 from the outer hollow tube 11.

Any other suitable means may be employed for relieving the pressure within the hollow tubes 11 and 12. For example, the threads 26 could have the first thread, which is where the openings 37 are located, formed with a pair of diametrically disposed flats. Thus, slight rotation of the locking nut 27 would relieve the pressure in the manner previously described.

Figure 2:
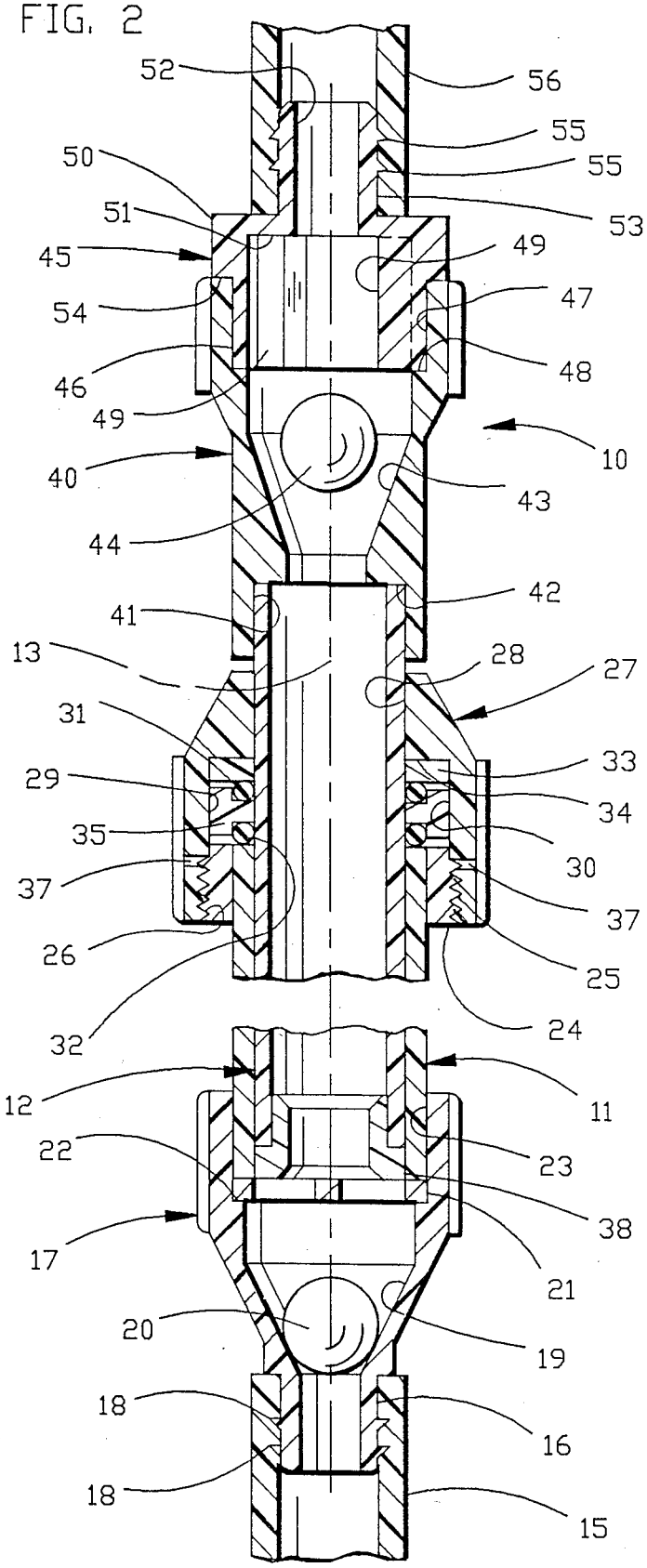
FIG. 2 is an enlarged fragmentary longitudinal sectional view, similar to FIG. 1, of the device of FIG. 1 and showing the device used as a pump with the inner hollow tube fully retracted into the outer hollow tube.

The inner hollow tube 12 has a stop ring 38 attached to its end disposed within the outer hollow tube 11. The stop ring 38, which is slightly larger than the outer diamter of the inner hollow tube 12, is secured to the inner hollow tube 12 by any suitable means such as an adhesive or ultrasonic welding, for example. The stop ring 38 limits extension of the inner hollow tube 12 from the outer hollow tube 11 by engaging the O-ring 32 as shown in FIGS. 3 and 9. The stop ring 38 also engages the stop 21 within the hollow inlet fitting 17 to limit the inward movement of the inner hollow tube 12 with respect to the outer hollow tube 11 as shown in FIG. 2.

The stop ring 38 also aids in guiding the inner hollow tube 12 within the outer hollow tube 11 in conjunction with the first inner circular surface 28 of the locking nut 27. The stop ring 38 has four grooves 39 (see FIG. 8) at equally angularly spaced portions about its circumference to prevent the stop ring 38 from functioning as a piston within the outer hollow tube 12 (see FIG. 2).

The inner hollow tube 12 has a hollow outlet fitting 40 at its distal end. One end of the hollow outlet fitting 40 has a recess 41 to receive the inner hollow tube 12 to have the distal end of the inner hollow tube 12 engage a shoulder 42 of the hollow outlet fitting 40. The recess 41 has its side wall tapering towards the shoulder 42 to enable easier insertion of the inner hollow tube 12 therein. The hollow outlet fitting 40 is attached to the inner hollow tube 12 by suitable means such as an adhesive or ultrasonic welding, for example, between the outer surface of the inner hollow tube 12 and the side wall of the recess 41.

The hollow outlet fitting 40 has a conical valve seat 43 formed therein with its center on the longitudinal axis 13 of the device 10. The conical valve seat 43 has the same selected angle relative to the longitudinal axis 13 of the device 10 as the conical valve seat 19.

A ball valve 44 is disposed within the hollow outlet fitting 40 and cooperates with the conical valve seat 43 to control liquid flow through the hollow outlet fitting 40. As previously discussed with respect to the cooperation between the conical valve seat 19 and the ball valve 20, the position of the longitudinal axis 13 of the device 10 relative to the horizontal determines when the ball valve 44 ceases to engage the conical valve seat 43 to form a seal therewith.

The ball valve 44 is caged within the hollow outlet fitting 40 by a stop 45. The stop 45 has an annular portion 46 disposed within a recess 47 in the hollow outlet fitting 40. The recess 47 has its side wall tapering towards a shoulder 48 to enable tight fit of the stop 45 within the hollow outlet fitting 40. The shoulder 48 of the hollow outlet fitting 40 limits insertion of the stop 45 within the hollow outlet fitting 40. The stop 45 is attached to the hollow outlet fitting 40 by suitable means such as an adhesive or ultrasonic welding, for example.

The stop 45 has three ribs 49 (see FIG. 4), which extend along the entire length of the inner surface of the annular portion 46 (see FIG. 2) of the stop 45 and along a portion of an inner suface of an annular portion 50 of the stop 45. The ends of the ribs 49 engage the ball valve 44 to limit movement of the ball valve 44 away from the conical valve seat 43.

Figure 7:
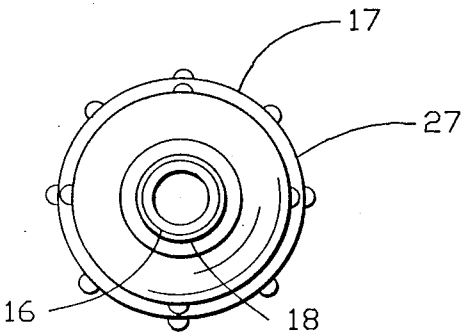
FIG. 7 is a right end elevational view of the device of FIG. 1 without the hose.
Figure 6:
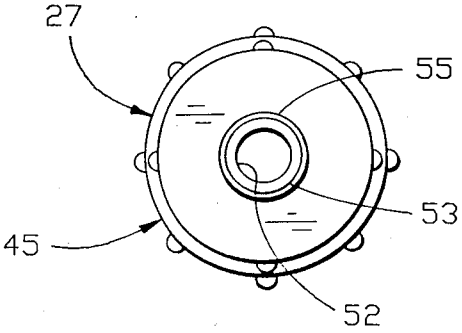
FIG. 6 is a left end elevational view of the device of FIG. 1 without the hose.
Figure 5:
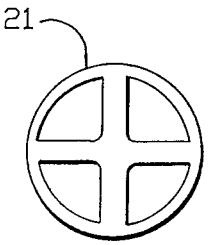
FIG. 5 is an end elevational view of a stop for the other of the ball valves of FIG. 1.
Figure 4:
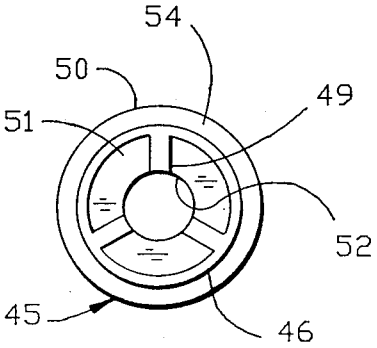
FIG. 4 is an end elevational view of a stop for one of the ball valves of the device of FIG. 1 and taken from the larger end of the stop.

The ribs 49 extend from an end wall 51 of the stop 45. A passage 52 extends through the end wall 51 and a reduced portion 53 of the stop 45. As shown in FIG. 4, the ribs 49 do not interfere with liquid flow through the passage 52 since the inner diameter of the ribs 49 is the same as the diameter of the passage 52.

When the stop 45 (see FIG. 2) is inserted within the hollow outlet fitting 40, a shoulder 54 of the stop 45 is adjacent the end of the hollow outlet fitting 40. The stop 45 has a pair of annular rings 55 on the reduced portion 53 to engage a hose 56 to retain the hose 56 on the stop 45. The hose 56 can direct the liquid from the device 10 to a container 57 (see FIG. 1), which must be lower than the source 14 of liquid when siphoning is occurring.

Considering the operation of the device 10, the device 10 must be initially positioned with the longitudinal axis 13 at an angle to the horizontal greater than the angle of each of the conical valve seats 19 and 43 to the longitudinal axis 13 irrespective of whether pumping or siphoning is to occur. Thus, with each of the conical valve seats 19 and 43 having an angle of $22\frac{1}{2}°$ to the longitudinal axis 13, the device 10 must be held so that the longitudinal axis 13 is at an angle greater than $22\frac{1}{2}°$ to the horizontal.

When pumping is to occur, the inner hollow tube 12 is manually reciprocated within the outer hollow tube 11 by the user. The initial extension of the inner hollow tube 12 from the outer hollow tube 11 increases the volume within the hollow tubes 11 and 12 to decrease the pressure therein to a partial vacuum in comparison with the pressure on the side of the ball valve 20 communicating with the hose 15. This pressure differential move the ball valve 20 away from the conical valve seat 19, as shown in FIG. 3, to cause liquid at the liquid source 14 (see FIG. 1) to be sucked up the hose 15. Depending on the length of the hose 15, the liquid from the source 14 may not enter the hollow tubes 11 and 12 for several reciprocating cycles.

When the inner hollow tube 12 is retracted into the outer hollow tube 11 as shown in FIG. 2, the volume within the hollow tube 11 and 12 decreases significantly. This increases the pressure within the hollow tubes 11 and 12 to cause the ball valve 20 to be seated on the conical valve seat 19 because of the pressure being greater within the hollow tubes 11 and 12 than in the hose 15. As the volume within the hollow tubes 11 and 12 continues to decrease with the ball valve 20 engaging the conical valve seat 19, the pressure within the tubes 11 and 12 becomes greater than atmospheric pressure so that the pressure differential across the ball valve 44 moves the ball valve 44 off the conical valve seat 43. This expels some of the air within the hollow tubes 11 and 12.

When the liquid from the source 14 (see FIG. 1) enters the interior of the tubes 11 and 12, the air is pushed out past the ball valve 44 during each retraction of the inner hollow tube 12 into the inner hollow tube 11, as shown in FIG. 2, until there is no air remaining within the hollow tubes 11 and 12 even during extension of the inner hollow tube 12 from the outer hollow tube 11 as shown in FIG. 3. When this occurs, the liquid is pumped by the device 10 to any desired location.

When siphoning is to occur, the device 10 is operated as a pump in the manner previously described until liquid flows into the hose 56. When this occurs, the user disposes the longitudinal axis 13 of the device 10 at an angle to the horizontal smaller than the angle of each of the conical valve seats 19 and 43 to the longitudinal axis 13. As shown in FIG. 1, this results in the ball valve 20 no longer seating on the conical valve seat 19 and the ball valve 44 no longer seating on the conical valve seat 43. Thus, flow from the source 14 to the container 57, which would have to be lower than the source 14, can occur by siphoning since the ball valves 20 and 44 do not prevent such.

Each of the ball valves 20 and 44 has the same mass. Each of the ball valves 20 and 44 is formed of a material such as stainless steel, for example, so that it will not float in the liquid flowing through the device 10. This insures faster opening and closing of the ball valves 20 and 44. Although it is not a necessity for operation that the ball valves 20 and 44 have such a mass that they are incapable of floating in the liquid, such is desired.

Except for the ball valves 20 and 44, the device 10 has all of its parts formed of plastic. Thus, there is no possibility of any spark occurring to cause an explosion from a liquid being pumped or siphoned through the device 10. Because the volume within the hollow tubes 11 and 12 decreases by about two-thirds of its maximum volume when the inner hollow tube 12 is retracted within the outer hollow tube 11, a relatively large height of liquid such as about sixteen feet of water, for example, can be lifted during each cycle of reciprocation of the hollow tubes 11 and 12.

The locking nut 27 (see FIG. 2) adjusts the pressure created by the O-rings 31 and 32 through the amount of tightening of the threads 26 on the locking nut 27 with the threads 25 on the collar 24. The enlarged portion of the T-shaped washer 35 exerts an inward force on the O-rings 31 and 32 towards the inner hollow tube 12 to increase the pressure of the O-rings 31 and 32 on the inner hollow tube 12 as the locking nut 27 is tightened on the collar 24.

While the device 10 has been shown as having the two O-rings 31 and 32 forming the seal between the outer hollow tube 11 and the inner hollow tube 12, it should be understood that sealing between the hollow tubes 11 and 12 could be obtained with only one of the O-rings 31 and 32. In such an arrangement, the one of the O-rings 31 and 32 would abut the end of the outer hollow tube 11 as the O-ring 32 does when both of the O-rings 31 and 32 are used. With only one of the O-rings 31 and 32, the washer 33 would not be required and the T-shaped washer 35 could have a flat surface bearing against the shoulder 34 of the locking nut 27 instead of the washer 33. However, it is preferred that there be the two O-rings 31 and 32.

As an example, the outer diameter of the inner hollow tube 12 is 0.847" and the inner diameter of the outer hollow tube 11 is 0.935" with the stop ring 38 having an outer diameter of 0.900". Thus, there is a slight spacing between the stop ring 38 and the outer hollow tube 11 as shown in FIG. 9.

An advantage of this invention is that no priming is required to siphon. Another advantage of this invention is that there is no piston to wear. A further advantage of this invention is that the seals between the inner and outer hollow tubes are easily replaceable. Still another advantage of this invention is that a relatively large displacement of liquid occurs during each cycle when the device is used as a pump. A still further advantage of this invention is that there is an adjustable pressure on the seals between the inner and outer hollow tubes. Yet another advantage of this invention is that it is a spark proof device. A yet further advantage of this invention is that it is not required for the device to be immersed in a liquid. Still yet another advantage of this invention is that it may be easily held in the hand of the user. A still yet further advantage of this invention is that no spring is required to move any valve to any position. Still another advantage of this invention is that no tight fit is required of the smaller tube within the larger tube.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A hand held and hand operated device for pumping or siphoning a liquid including:

a first hollow tube;

a second hollow tube telescopingly received within said first hollow tube to enable reciprocating movement therebetween, said first and second hollow tubes having a single longitudinal axis;

sealing means to form a seal between said first and second hollow tubes and to maintain the seal during reciprocating movement between said first and second hollow tubes;

each of said first and second hollow tubes having a conical valve seat adjacent its distal end, each of said conical valve seats having the same angle relative to the longitudinal axis of said first and second hollow tubes, each of said conical valve seats having its center on the longitudinal axis of said first and second hollow tubes;

a ball valve cooperating with each of said conical valve seats;

means to limit the movement of each of said ball valves away from said conical valve seat with which said ball valve cooperates;

each of said ball valves engaging said conical valve seat with which it cooperates so as to be responsive to pressure differentials when said first and second hollow tubes are disposed with the longitudinal axis at an angle to the horizontal greater than the angle of each of said conical valve seats to the longitudinal axis of said first and second hollow tubes so that said device functions as a pump for pumping a liquid from a source during reciprocating movement between said first and second hollow tubes with one of said first and second hollow tubes communicating with a source of liquid;

and each of said ball valves being removed from engagement with said conical valve seat with which it cooperates when said first and second hollow tubes are disposed with the longitudinal axis at an angle to the horizontal less than the angle of each of said conical valve seats to the longitudinal axis of said first and second hollow tubes so that said device functions as a siphon for siphoning a liquid from the source after flow of liquid has been started through said first and second hollow tubes by using said device as a pump.

2. The device according to claim 1 in which said sealing means includes seal relieving means to relieve the seal.

3. The device according to claim 2 in which said sealing means includes:

seal retaining means supported on said first hollow tube;

and at least one seal forming a seal between said first and second hollow tubes and retained in position by said seal retaining means, said one seal engaging the outer surface of said second hollow tube.

4. The device according to claim 3 in which said seal retaining means includes said seal relieving means.

5. The device according to claim 4 in which:

said seal retaining means includes:

first means fixed to said first hollow tube;

second means releasably connected to said first means;

and said second means including holding means to hold said one seal in engagement with the outer surface of said second hollow tube and against displacement in a direction parallel to the longitudinal axis of said first and second hollow tubes.

6. The device according to claim 5 in which said seal retaining means includes means to prevent twisting of said one seal when said second means of said seal retaining means is connected to said first means of said seal retaining means.

7. The device according to claim 4 in which:

said sealing means includes two seals;

and said seal retaining means includes:

first means fixed to said first hollow tube;

second means releasably connected to said first means;

said second means including holding means to hold said seals in engagement with the outer surface of said second hollow tube and against displacement in a direction parallel to the longitudinal axis of said first and second hollow tubes;

and said holding means of said second means including seal separating means disposed between said two seals to separate them in a direction parallel to the longitudinal axis of said first and second hollow tubes.

8. The device according to claim 7 in which said seal retaining means includes means to prevent twisting of said seal furthest from said first hollow tube when said second means of said seal retaining means is connected to said first means of said seal retaining means.

9. The device according to claim 1 in which said sealing means includes:

seal retaining means supported on said first hollow tube;

and at least one seal forming a seal between said first and second hollow tubes and retained in position by said seal retaining means, said one seal engaging the outer surface of said second hollow tube.

10. The device according to claim 9 in which:

said seal retaining means includes:

first means fixed to said first hollow tube;

second means releasably connected to said first means;

and said second means including holding means to hold said one seal in engagement with the outer surface of said second hollow tube and against displacement in a direction parallel to the longitudinal axis of said first and second hollow tubes.

11. The device according to claim 10 in which said seal retaining means includes means to prevent twisting of said one seal when said second means of said seal retaining means is connected to said first means of said seal retaining means.

12. The device according to claim 9 in which:

said sealing means includes two seals;

and said seal retaining means includes:

first means fixed to said first hollow tube;

second means releasably connected to said first means;

said second means including holding means to hold said seals in engagement with the outer surface of said second hollow tube and against displacement in a direction parallel to the longitudinal axis of said first and second hollow tubes;

and said holding means of said second means including seal separating means disposed between said two seals to separate them in a direction parallel to the longitudinal axis of said first and second hollow tubes.

13. The device according to claim 12 in which said seal retaining means includes means to prevent twisting of said seal furthest from said first hollow tube when said second mean of said seal retaining means is connected to said first means of said seal retaining means.

14. The device according to claim 1 in which each of said balls is heavier than a liquid to be pumped or siphoned.

15. A hand held and hand operated device for pumping or siphoning a liquid including:

a first hollow tube;

a second hollow tube telescopingly received within said first hollow tube to enable reciprocating movement therebetween, said first and second hollow tubes having a single longitudinal axis;

sealing means to form a seal between said first and second hollow tubes and to maintain the seal during reciprocating movement between said first and second hollow tube;

said first hollow tube having first valve means at its distal end;

said second hollow tube having second valve means at its distal end;

each of said first valve means and said second valve means including opening and closing means to open and close in response to reciprocating movement between said first and second hollow tubes when said first and second hollow tubes are disposed with their longitudinal axis at a first angle to the horizontal greater than a predetermined angle so that liquid is pumped from a liquid source communicating with said first valve means to beyond said second valve means;

and each of said first valve means and said second valve means including means to render said opening and closing means of each of said first valve means and said second valve means ineffective when said first and second hollow tubes are disposed with their longitudinal axis at a second angle to the horizontal smaller than the predetermined angle so that liquid is siphoned from a liquid source after said first and second hollow tubes have been disposed at the first angle and there has been reciprocating movement between said first and second hollow tubes to pump liquid beyond said second valve means.

16. The device according to claim 15 in which said sealing means includes:

seal retaining means supported on said first hollow tube;

and at least one seal forming a seal between said first and second hollow tubes and retained in position by said seal retaining means, said one seal engaging the outer surface of said second hollow tube.

17. The device according to claim 16 in which:

said seal retaining means includes:

first means fixed to said first hollow tube;

second means releasably connected to said first means;

and said second means including means to hold said one seal in engagement with the outer surface of said second hollow tube and against displacement in a direction parallel to the longitudinal axis of said first and second hollow tubes.

18. The device according to claim 17 in which said seal retaining means includes means to prevent twisting of said one seal when said second means of said seal retaining means is connected to said first means of said seal retaining means.

19. The device according to claim 16 in which:

said sealing means includes two seals;

and said seal retaining means includes:

first means fixed to said first hollow tube;

second means releasably connected to said first means;

said second means including holding means to hold said seals in engagement with the outer surface of said second hollow tube and against displacement in a direction parallel to the longitudinal axis of said first and second hollow tubes;

and said holding means of said second means of said seal retaining means including seal separating means disposed between said two seals to separate them in a direction parallel to the longitudinal axis of said first and second hollow tubes.

20. The device according to claim 19 in which said seal retaining means includes means to prevent twisting of said seal furthest from said first hollow tube when said second means of said seal retaining means is connected to said first means of said seal retaining means.

* * * * *

UNITED STATES PATENT AND TRADEMARK OFFICE

CERTIFICATE OF CORRECTION

PATENT NO. : 4,574,828

DATED : March 11, 1986

INVENTOR(S) : William B. Brumfield

It is certified that error appears in the above-identified patent and that said Letters Patent is hereby corrected as shown below:

Column 1, line 63, "oow" should read --- ow ---.

Column 2, line 37, "o" should read --- on ---.

Column 3, line 24, after "the" insert --- outer ---.

Column 4, line 42, "oute" should read --- outer ---.

Column 5, line 63, after "enable" insert --- a ---.

Column 6, line 41, "move" should read --- moves ---.

Column 6, line 49, "tube" should read --- tubes ---.

Column 6, line 65, "inner" (second occurrence) should read --- outer ---.

Column 10, line 41, "tube" should read --- tubes ---.

Signed and Sealed this

*Fifth* Day of *August 1986*

[SEAL]

*Attest:*

DONALD J. QUIGG

*Attesting Officer*

*Commissioner of Patents and Trademarks*